US007121987B2

(12) United States Patent
Sharps

(10) Patent No.: US 7,121,987 B2
(45) Date of Patent: Oct. 17, 2006

(54) GOLF EXERCISE DEVICE

(76) Inventor: Chester H. Sharps, 3 Broad Run Rd., Manakin Sabot, VA (US) 23103

( * ) Notice: Subject to any disclaimer, the term of this patent is extended or adjusted under 35 U.S.C. 154(b) by 566 days.

(21) Appl. No.: 10/669,922

(22) Filed: Sep. 24, 2003

(65) Prior Publication Data

US 2004/0063552 A1 Apr. 1, 2004

Related U.S. Application Data

(60) Provisional application No. 60/413,191, filed on Sep. 24, 2002.

(51) Int. Cl.
*A63B 69/36* (2006.01)
*A63B 23/02* (2006.01)

(52) U.S. Cl. ..... 482/92; 482/100; 482/111; 482/129; 482/136

(58) Field of Classification Search ..... 482/92–94, 482/98–100, 111, 121, 127, 129, 130; 473/207, 473/219, 256, 266
See application file for complete search history.

(56) References Cited

U.S. PATENT DOCUMENTS 3,397,892 A * 8/1968 Stahl ..... 473/276
3,738,661 A * 6/1973 Moller ..... 473/229
3,876,212 A * 4/1975 Oppenheimer ..... 473/221
3,926,430 A 12/1975 Good, Jr.
4,296,924 A 10/1981 Anzaldua et al.
4,326,718 A 4/1982 Kiehl
4,456,245 A 6/1984 Baldwin
4,521,023 A * 6/1985 Williams ..... 473/274
4,583,740 A 4/1986 Ohly
4,732,381 A * 3/1988 Skowronski ..... 482/134
4,733,860 A 3/1988 Steffee
4,758,000 A * 7/1988 Cox ..... 473/208
4,978,119 A 12/1990 Hull
5,022,647 A 6/1991 Fulcher
5,039,091 A 8/1991 Johnson
5,050,871 A * 9/1991 Douglas et al. ..... 482/110
5,104,121 A 4/1992 Webb
5,125,882 A 6/1992 La Mothe et al.
5,156,402 A * 10/1992 Hart ..... 473/229
5,158,299 A 10/1992 Otter
5,242,344 A 9/1993 Hundley
5,529,552 A 6/1996 Biedermann et al.
5,984,797 A 11/1999 Kessler et al.

(Continued)

OTHER PUBLICATIONS

WIPO, International Search Report dated Jul. 27, 2004, International Patent Application No. PCT/US03/30078, 5 pages.

*Primary Examiner*—Jerome Donnelly
*Assistant Examiner*—Victor K. Hwang
(74) *Attorney, Agent, or Firm*—Hunton & Williams LLP

(57) ABSTRACT

Disclosed is a golf exercise weight machine for anaerobically strengthening the large rotary muscles of the body—including the upper thigh, trunk and abdomen, and shoulders—most used in performing a golf swing. Preferably, the device includes a floor mounted base to which a yoke is rotatably attached to fit around the shoulders and arms of a user, so that during operation the user's body remains oriented in the proper swing position so as to mimic and improve the golf swing by strengthening the appropriate muscles. A weight stack provides variable resistance during the simulated golf swing, and the device offers adjustment over multiple degrees of freedom and it can accommodate both right-and left-handed swings.

16 Claims, 12 Drawing Sheets

U.S. PATENT DOCUMENTS

| | | | | |
|---|---|---|---|---|
| 6,013,013 | A | 1/2000 | Wolf | |
| 6,174,270 | B1 | 1/2001 | Dagenais | |
| RE37,132 | E | 4/2001 | Douglas et al. | |
| 6,371,863 | B1 * | 4/2002 | Moran | 473/207 |
| 6,579,214 | B1 | 6/2003 | Crump | |
| 2005/0014571 | A1 * | 1/2005 | Varner | 473/257 |
| 2006/0003875 | A1 * | 1/2006 | Sharps | 482/100 |

* cited by examiner

GOLF EXERCISE DEVICE

This application claims the priority of U.S. Provisional Patent Application No. 60/413,191 filed on Sep. 24, 2002, which is incorporated herein by reference in its entirety.

BACKGROUND OF THE INVENTION

The invention is directed to a golf exercise device, and, more particularly, to a golf exercise device that is adjustable to accommodate various-sized users and is designed to mimic and improve the golf swing by aerobically and/or anaerobically strengthening the large rotary muscles of the body—including the upper thigh, trunk and abdomen, and shoulders—most used in performing a golf swing, and to train the swing in the proper muscle usage.

Conventional exercises and exercise machines, such as Nautilus or other weight or resistance-type systems, are frequently used to strengthen muscles of the body. For example, the abdominal muscles are strengthened through sit ups or specialty abdominal strengtheners. Also, muscles of the chest and shoulders are strengthened through a variety of chest and shoulder press machines. Likewise, leg press machines can be used to strengthen the thigh muscles. These types of machines are readily available at gymnasiums, and in the home. However effective these machines may be at offering weight-resistant strength training, the muscles are not trained or strengthened in a manner that is analogous to the golf swing.

There are other specialty devices geared towards improving the golf swing. Such devices include weighted golf clubs or a golf club device with a fan or some other form of air resistance. Nevertheless, such devices provide only limited resistance and predominantly strengthen the hands and forearms; they do not have the isotonic strengthening benefits of a machine that turns with the large rotary muscles that are so important to a proper golf swing.

Therefore, there remains a need for a device that can simultaneously guide a user through the proper golf swing and strengthen the large rotary muscles used during the performance of a proper golf swing.

SUMMARY OF THE INVENTION

It is an object of the present invention to provide a device that can guide a user through a proper golf swing, and to train the user in that proper golf swing.

It is another object of the present invention to provide a device in which the trajectory and movement of a user's body during a proper golf swing are encouraged through progressive resistance training of the muscles used during a proper golf swing.

It is another object of the present invention to provide a device for aerobically and/or anaerobically strengthening the large rotary muscles of the body, including the upper thigh, trunk and abdomen, and shoulders, most used in performing a golf swing.

It is another object of the present invention to provide a device that not only can be oriented and adjusted to mimic the position of a user's body during a "proper" golf swing, but that can be adjusted to fit the position and dimensions of other user's bodies as well.

It is another object of the present invention to provide a device that offers multiple degrees of freedom of adjustment.

It is another object of the present invention to provide a device that can offer variable resistance to the user during the simulated golf swing.

It is another object of the present invention to guide the user into proper swing mechanics due to the large muscle forces needed to turn the device against variable weight resistance.

Further objects, features and advantages of the invention will be apparent from the detailed description below taken in conjunction with the accompanying drawings.

BRIEF DESCRIPTION OF THE FIGURES

The present invention can be more fully understood by reading the following detailed description of the presently preferred embodiments together with the accompanying drawings, in which like reference indicators are used to designate like elements, and in which.

DETAILED DESCRIPTION OF PREFERRED EMBODIMENTS OF THE INVENTION

Operation of preferred embodiments of the present invention will now be described with reference to FIGS. 1–12. Any specific dimensions, angular orientations or configurations depicted in the figures are for representation of the preferred embodiments herein and should not be interpreted as limiting or restrictive to the scope of the invention.

Figure 1:
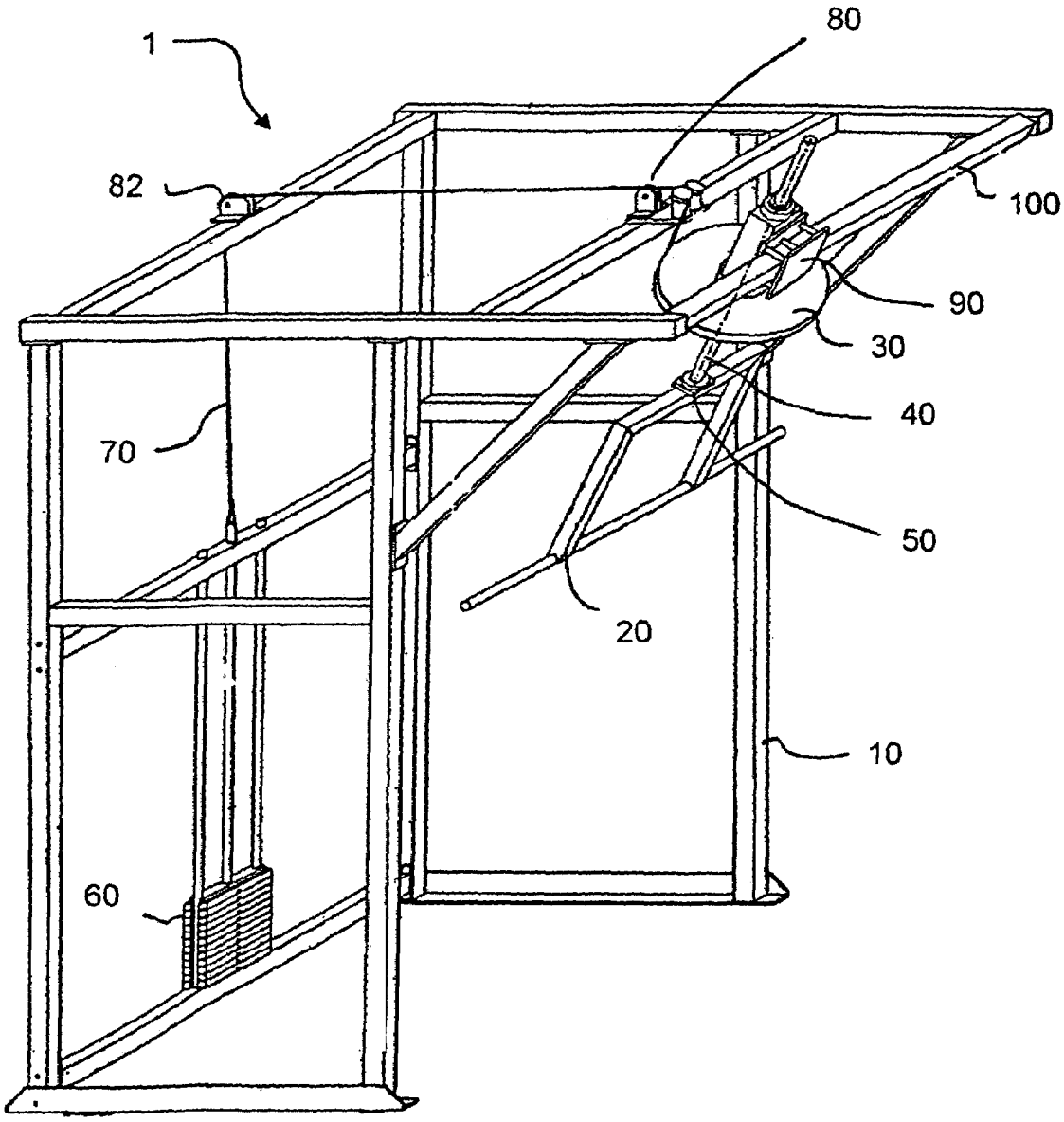
FIG. 1 depicts a left perspective view of a golf exercise device, configured for a right-hand swing, in accordance with an embodiment of the present invention.

As shown in FIG. 1, a preferred embodiment of golf exercise device 1 includes a frame 10 that supports a yoke 20. Yoke 20 is rotatably connected to the frame 10 through a flywheel 30 and support arm 40. Preferably, the yoke 20 has a center of rotation that is aligned with the ideal position of the golfer's spine during a golf swing and there is a 360-degree rotational joint 50 at the base of the support arm 40.

As the golfer's body twists about this center of rotation, that is, as the golfer performs a simulated golf swing and accordingly twists his/her body around a "fixed spine," the yoke 20 twists and turns the rotational joint 50, which turns the support arm 40, which turns the flywheel 30, which lifts a resistance 60 that is connected to the flywheel 30 through a cable 70, a first pulley 80, and a second pulley 82. In this embodiment, resistance 60 is comprised of a weight stack. By varying the amount of weight on resistance 60, the difficulty of the twisting motion can be varied to provide gradually increasing (or decreasing) resistance and strength training.

Figure 5:
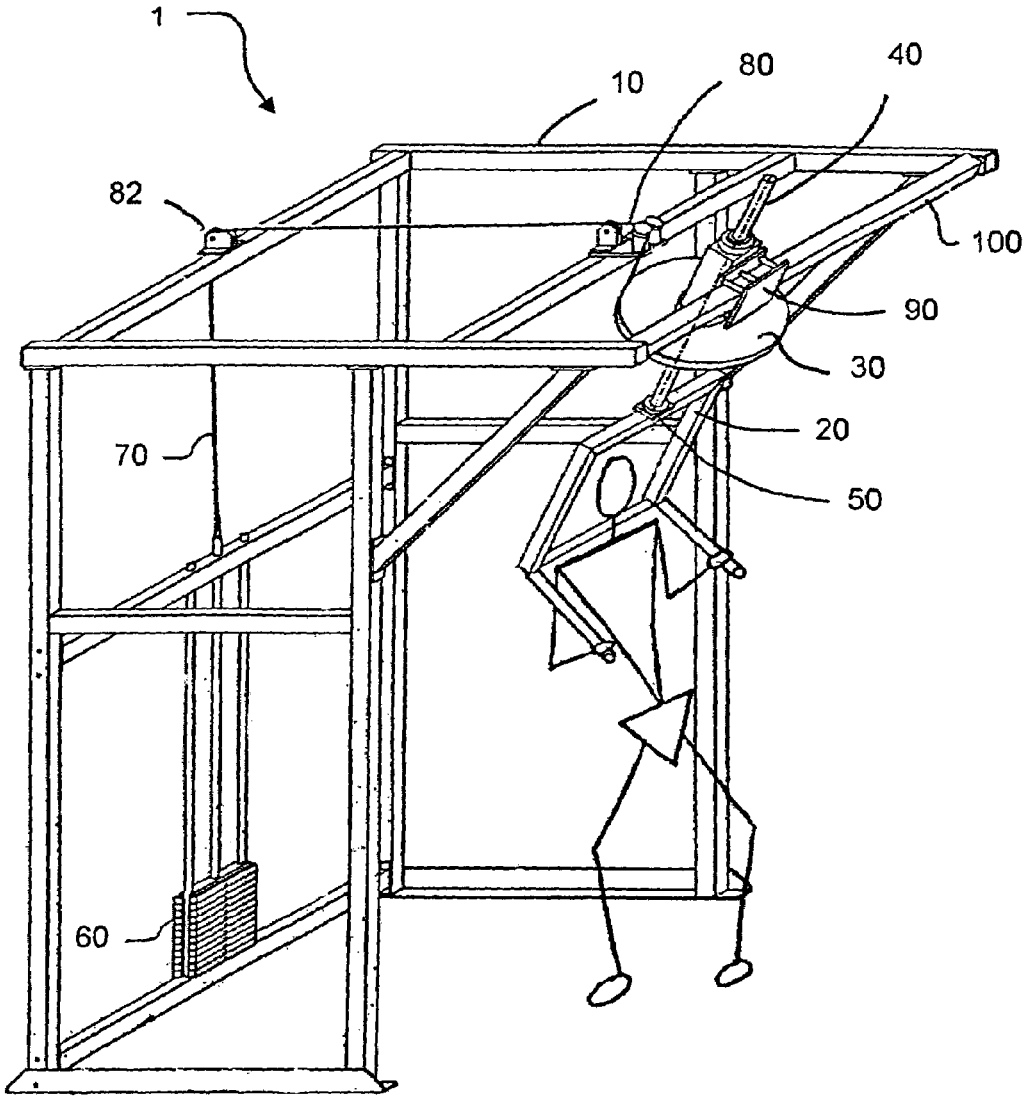
FIG. 5 depicts a left perspective view of a golf exercise device, configured for a right-hand swing with the yoke in a hands-forward position, depicting a user inside the frame in accordance with an embodiment of the present invention.
Figure 6:
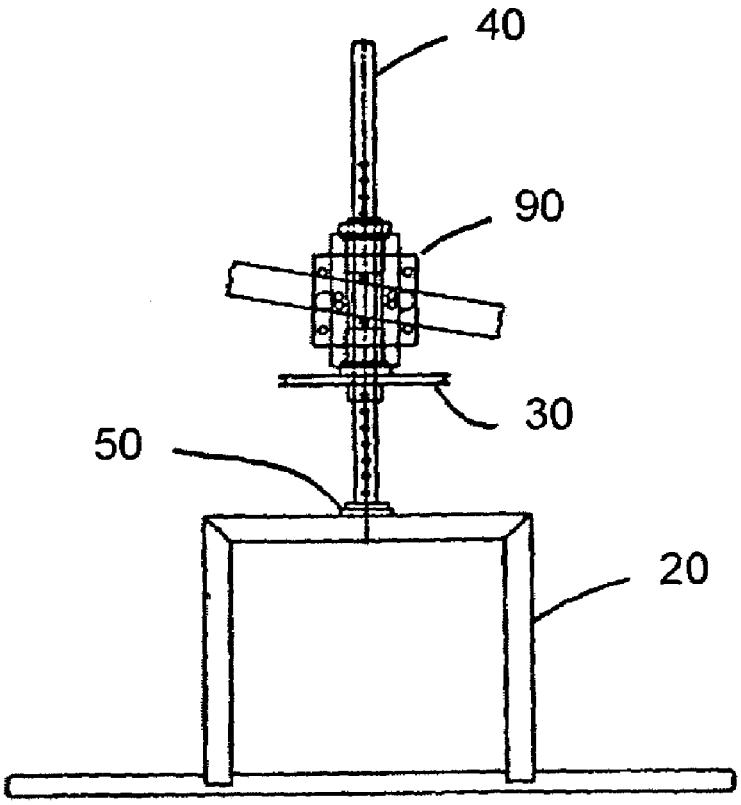
FIG. 6 depicts a front view of the flywheel-yoke-support arm component subassembly in accordance with an embodiment of the present invention.
Figure 7:
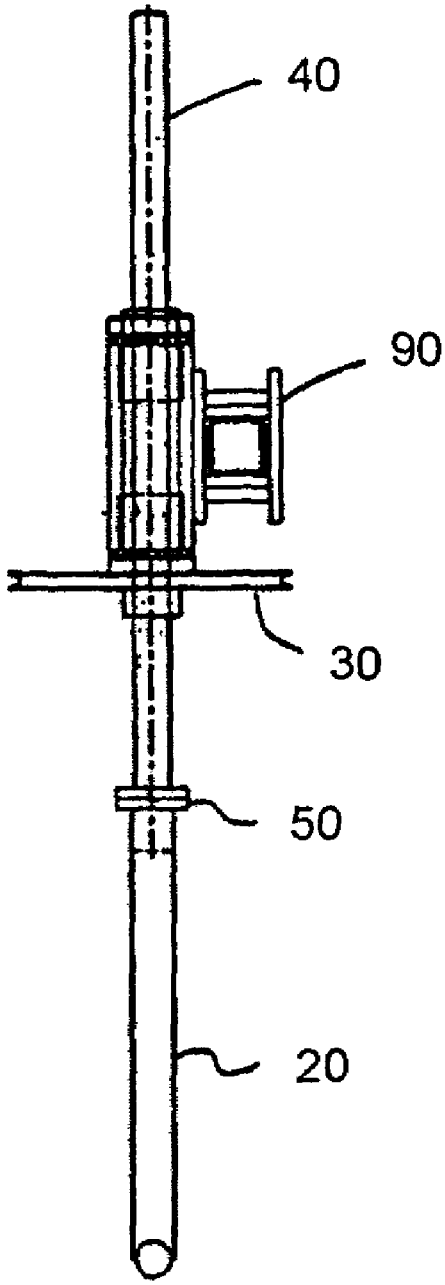
FIG. 7 depicts a side view of the flywheel-yoke-support arm component subassembly in accordance with an embodiment of the present invention.
Figure 8:
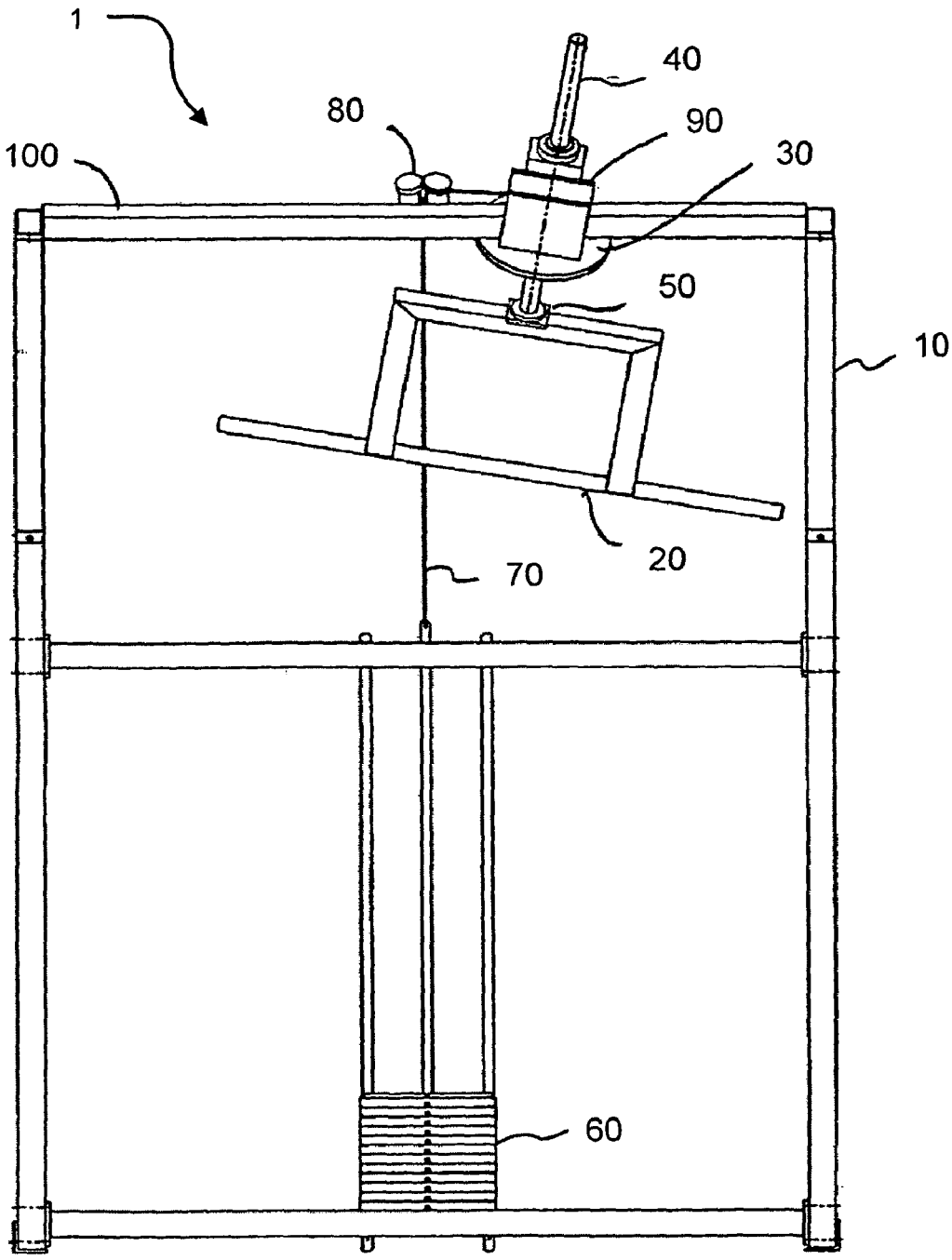
FIG. 8 depicts a front view of a golf exercise device, configured for a left-hand swing, in accordance with an embodiment of the present invention.

Other embodiments of the invention configured for a right-handed swing are displayed in FIGS. 2–5 and 9–12, including an illustrative view of the golf exercise device with the addition of a user performing a right-handed swing, and representative component subassemblies are depicted in FIGS. 6–7. Also included is an illustrative view of the present invention configured for a left-handed swing as shown in FIG. 8.

The position and orientation of the golf exercise device user are generally important to the training and strengthening aspects of the invention. In at least one embodiment of the invention, the position and orientation of a right-handed golfer's spine during the golf swing is at about 30 degrees to vertical (i.e., a forward inclination of about 30 degrees to the right of vertical as reflected by the angle "θ" in the side view of FIG. 2), with about 10-degree lateral tilt (i.e., about 10-degree tilt, or posterior inclination, to the left of vertical as reflected by the angle "α" in the front view of FIG. 3). In such embodiments, the axis of rotation of the support arm 40 is at θ=about 30-degrees and α=about 10-degrees.

It should be appreciated however that other angular positions and orientations may be employed with this invention and are to be considered within the scope of the present disclosure. For example, the golf exercise device allows the yoke's center of rotation to be adjustable in height and in angular orientation to accommodate different body types and sizes of golfers. Also, for a left-handed golfer, the user's body position would ostensibly be a mirror image of that for a right-handed golfer as depicted in FIG. 8. As such, golf exercise device 1 is adjustable from a right-handed training configuration to left-handed, and vice versa. This is also advantageous because some exercise physiologists believe that it is best to strengthen the muscles in the opposite direction of the primary muscles.

The adjustment capability of the disclosed invention offers the ability to vary the position and orientation of the device in multiple degrees of freedom. These degrees of freedom include, but are not limited to, the height of the yoke's position; the forward inclination of the yoke's center of rotation (i.e., the angle θ in FIG. 2); the posterior inclination of the yoke's center of rotation (i.e., the angle α in FIG. 3); and the rotation of the support arm 40 about the yoke's center of rotation (i.e., the angle β in FIG. 1). Support arm 40 may be adjustable in guide support 90 to accommodate golf exercise device users of varying heights and sizes. In some embodiments, support arm 40 may be adjusted by utilizing a series of spaced bores (as shown in FIG. 6) in support arm 40 through which a securing pin may be inserted to lock the desired height in place. Other temporary locking arrangements may also be used, in other embodiments, such as a locking collar, detents in cooperation with spring tensioned bearings, bolt washer and nut configurations, screws and threaded bores, or other suitable arrangements that serve to hold the support arm at the desired height during use of the golf exercise device.

Descriptions of components that are included in various preferred embodiments of the present invention will now be provided with reference to FIGS. 1–12.

As shown in FIG. 1, golf exercise device 1 includes a frame 10 (or "support structure"), having a wide base for providing structural support and stability to the remaining components of golf exercise device 1 and for providing stability to the golfer during performance of the golf swing. Frame 10 comprises a floor-mounted base and a number of vertical, horizontal and diagonal structural support members, as further exemplified in FIGS. 1–5 and 8. The width and spacing of the support members is preferably selected to allow free rotational movement of the yoke 20 (discussed below) and to provide ease of ingress and egress for the user.

Figure 11:
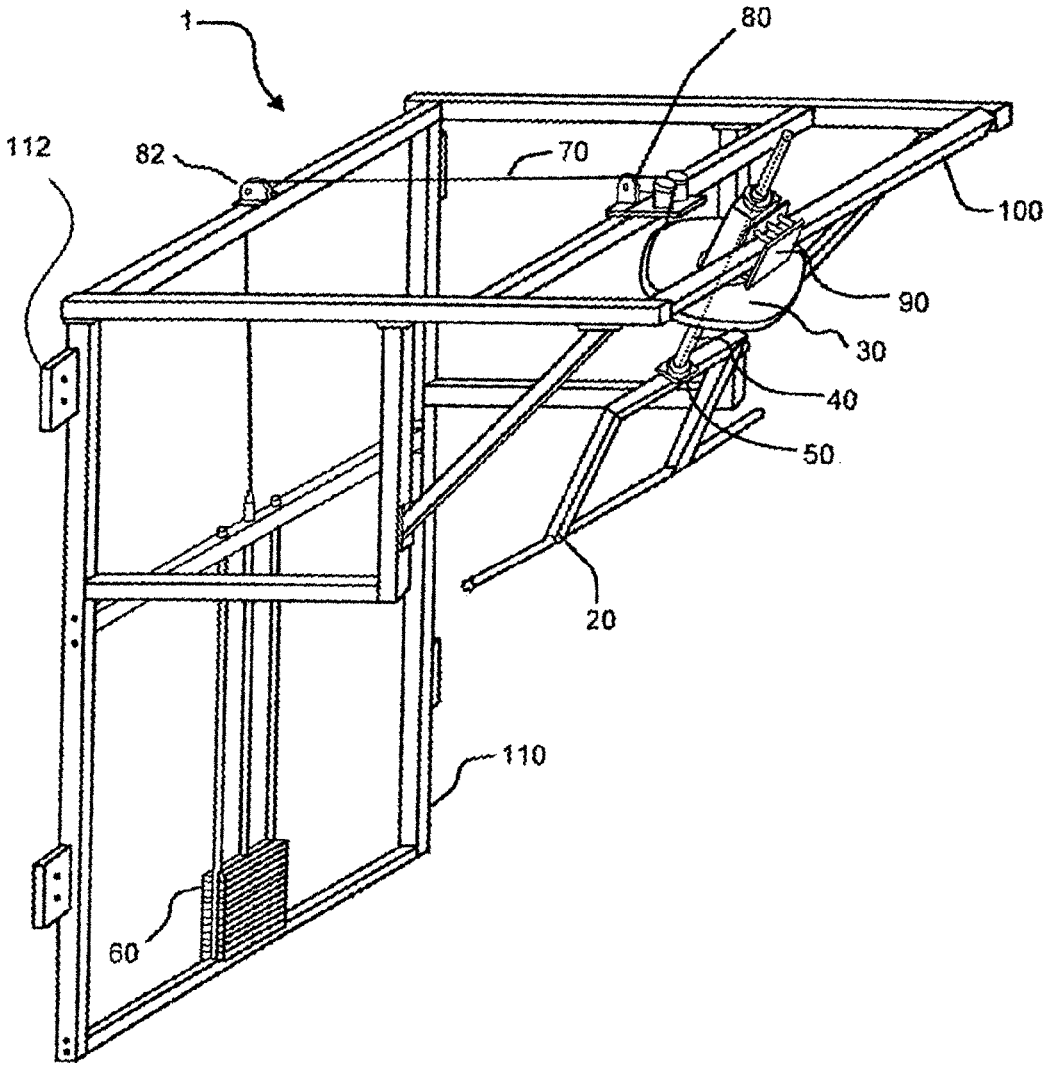
FIG. 11 depicts a left perspective view of a golf exercise device, configured for a right-hand swing, in accordance with an embodiment of the present invention.
Figure 12:
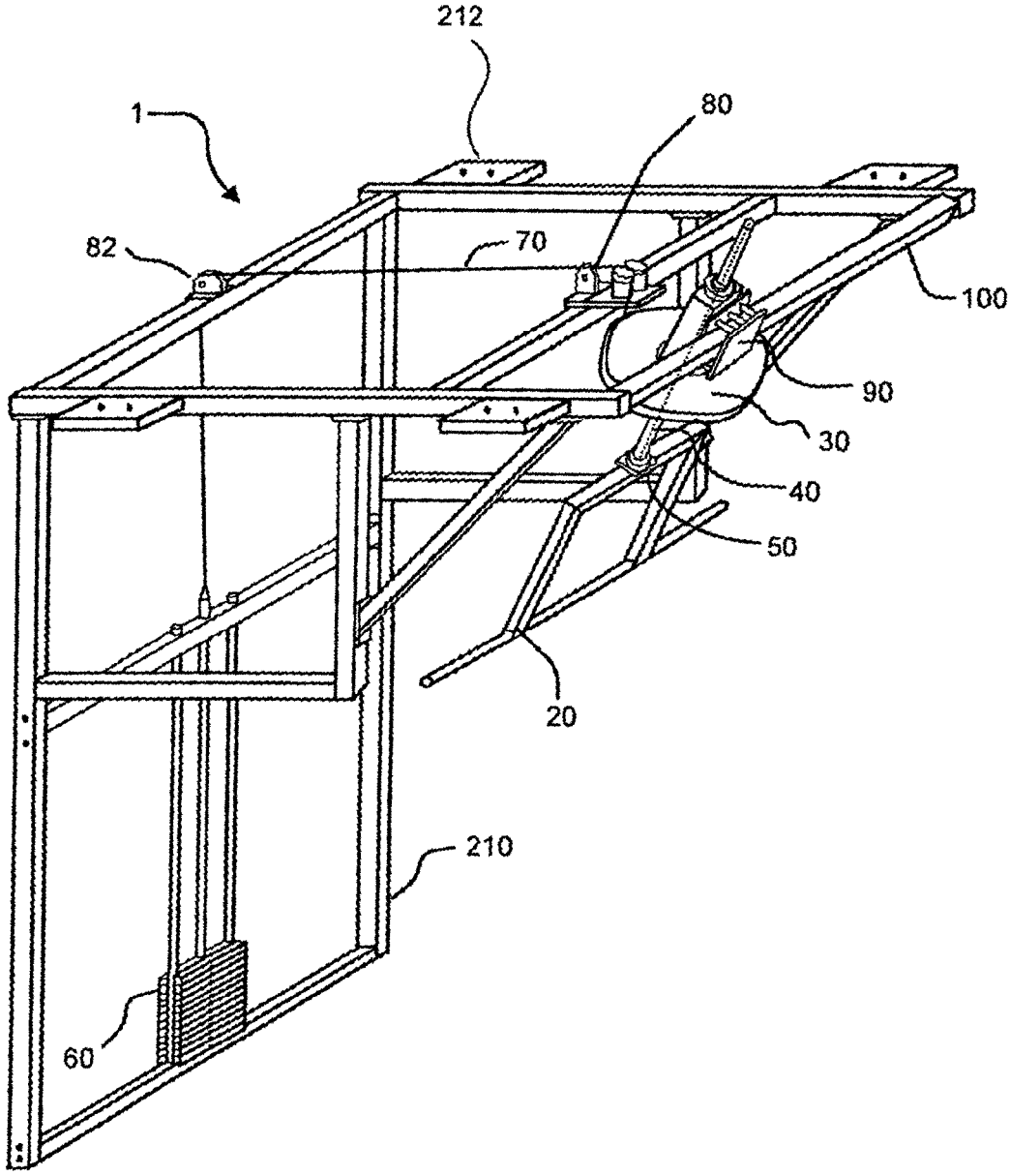
FIG. 12 depicts a left perspective view of a golf exercise machine, configured for a right-hand swing, in accordance with an embodiment of the present invention.

Other configurations of frame 10 that allow freedom of movement for the golfer during performance of the golf swing are to be considered within the scope of the present disclosure. For example, the golf exercise device may be supported from above (i.e., a ceiling-mounted system) or mounted on a side wall or other support structure (i.e., a wall-mounted system), provided that there is adequate structural rigidity to minimize flexibility or movements of the support structure that could interfere with the performance of a proper golf swing. FIG. 11 illustrates an embodiment of the invention where a frame 110 is configured to be mounted on a side wall or other structure. Support brackets 112 may be used to secure frame 110 to a wall or other surface. Alternatively, FIG. 12 illustrates an embodiment of the invention where frame 210 is configured to be supported from above, such as from a ceiling. Support brackets 212 may be used to secure frame 210 to the ceiling.

The various frames of the different embodiments of golf exercise device may be attached to the floor, wall or ceiling by various means, including welding, threaded bolts or screws and/or inserting the frame into a set of grooves or channels designed to hold the frame in place. It should be further be appreciated that in some embodiments the golf exercise device frame may be free standing and mobile. Accordingly, the golf exercise device can be moved to various places within a gymnasium or workout area. In such embodiments, the width and weight of frame 10 prevents exercise device 1 from shifting during use.

Figure 9:
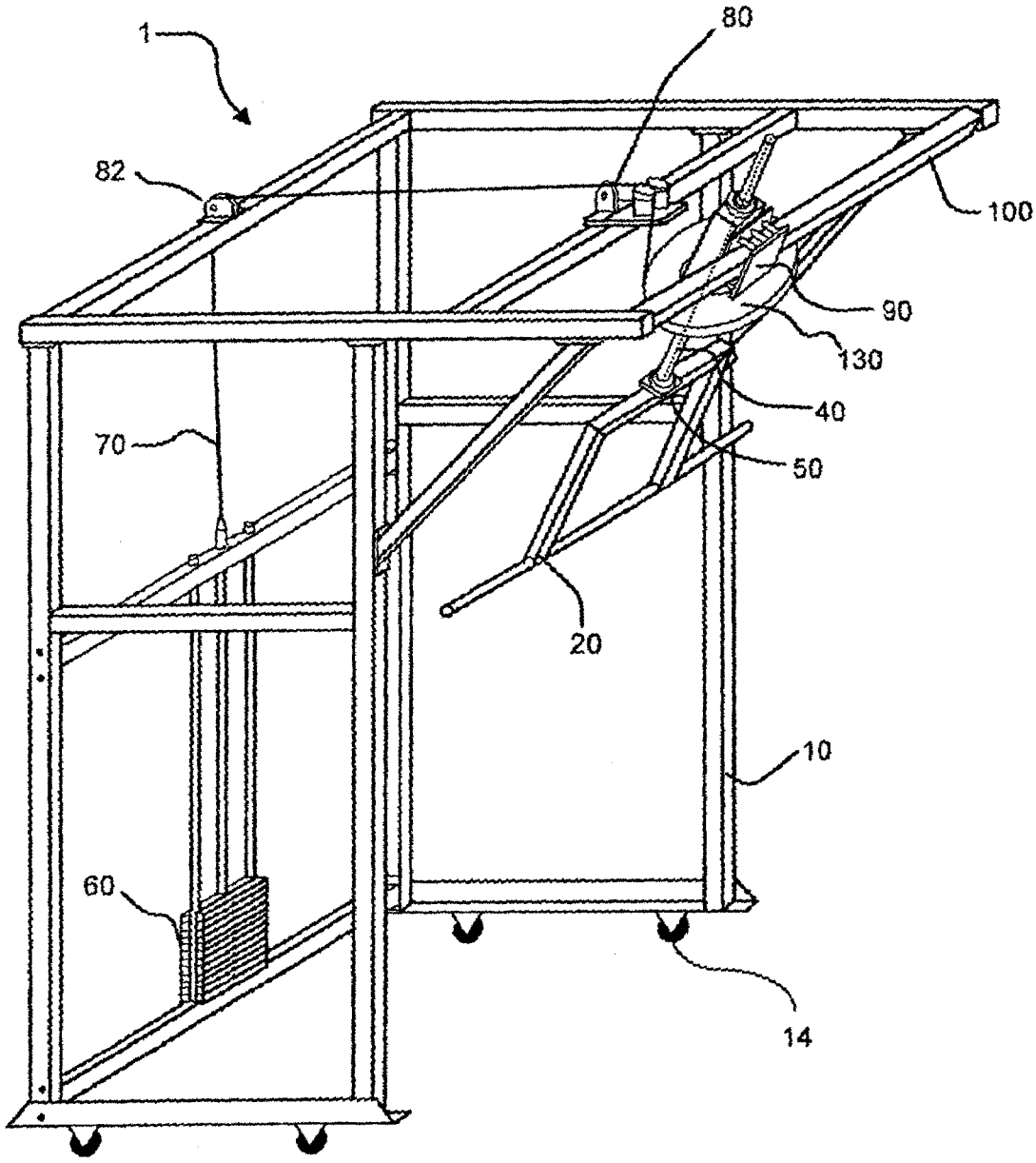
FIG. 9 depicts a left perspective view of a golf exercise device, configured for a right-hand swing, in accordance with an embodiment of the present invention.

In another embodiment, frame 10 may be modified with the addition of wheels or other means of transportability, such that golf exercise device 1 may be readily transported to a golf range or other athletic venue. This would allow the user to use golf exercise device 1 to get the feel of a proper golf swing and then be able to immediately hit real golf shots with actual golf equipment. FIG. 9 illustrates one embodiment of the invention in which wheels 14 are attached to frame 10, such that golf exercise device 1 can be readily transported from one location to another. It should be appreciated that wheels 14 may be configured such that prior to use of golf exercise device 1, they may be prevented from use by a braking or locking mechanism.

Figure 2:
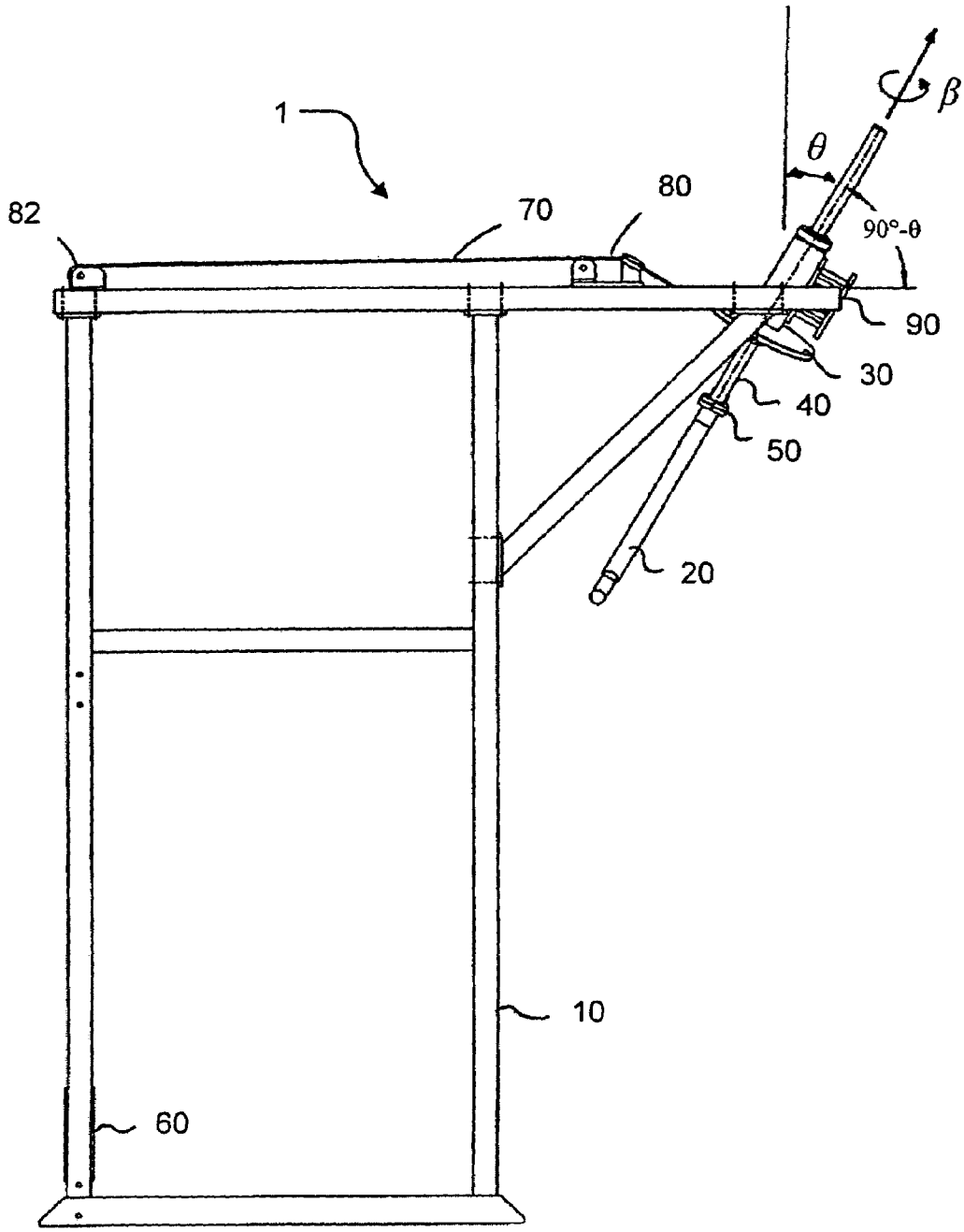
FIG. 2 depicts a left side view of a golf exercise device, configured for a right-hand swing, in accordance with an embodiment of the present invention.
Figure 3:
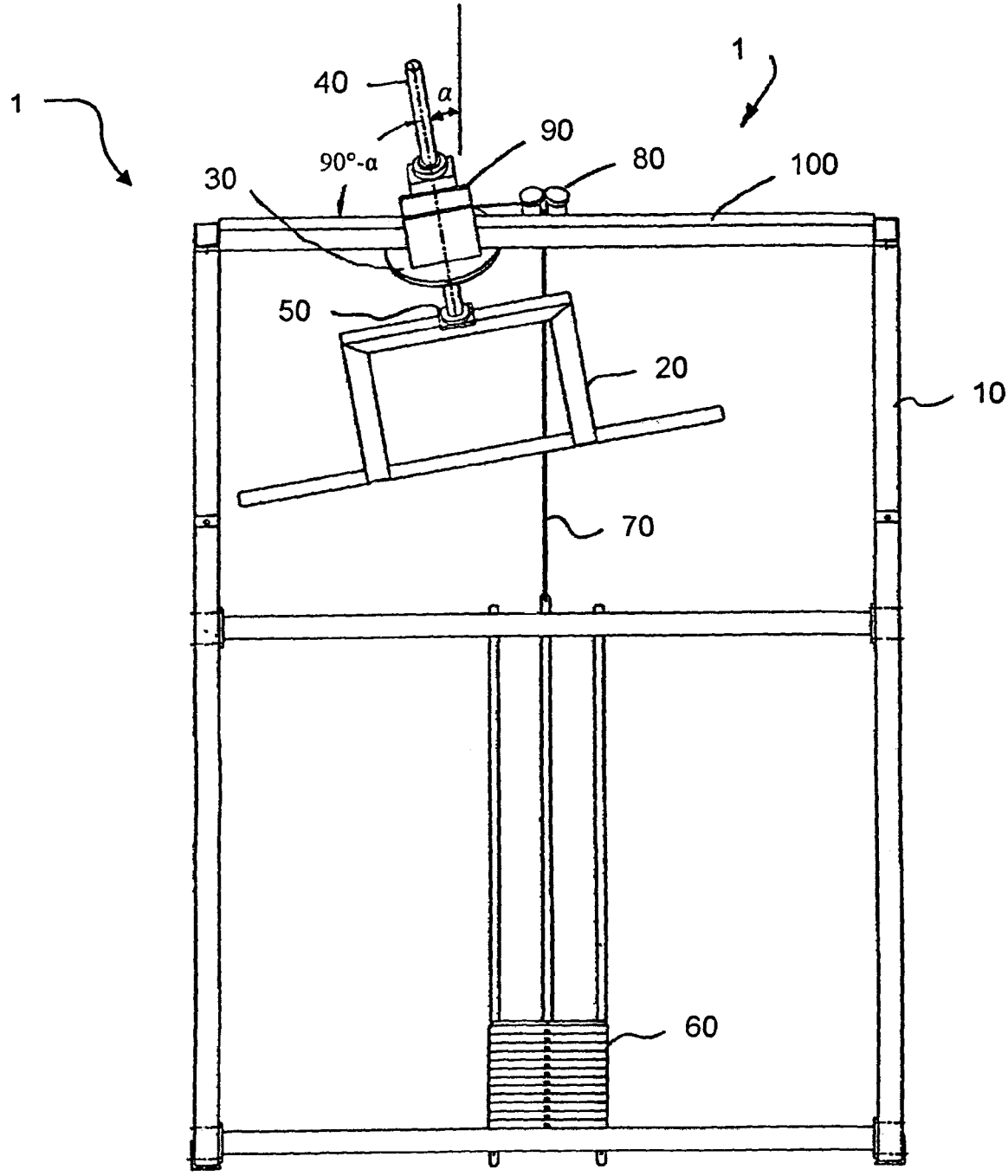
FIG. 3 depicts a front view of a golf exercise device, configured for a right-hand swing, in accordance with an embodiment of the present invention.
Figure 4:
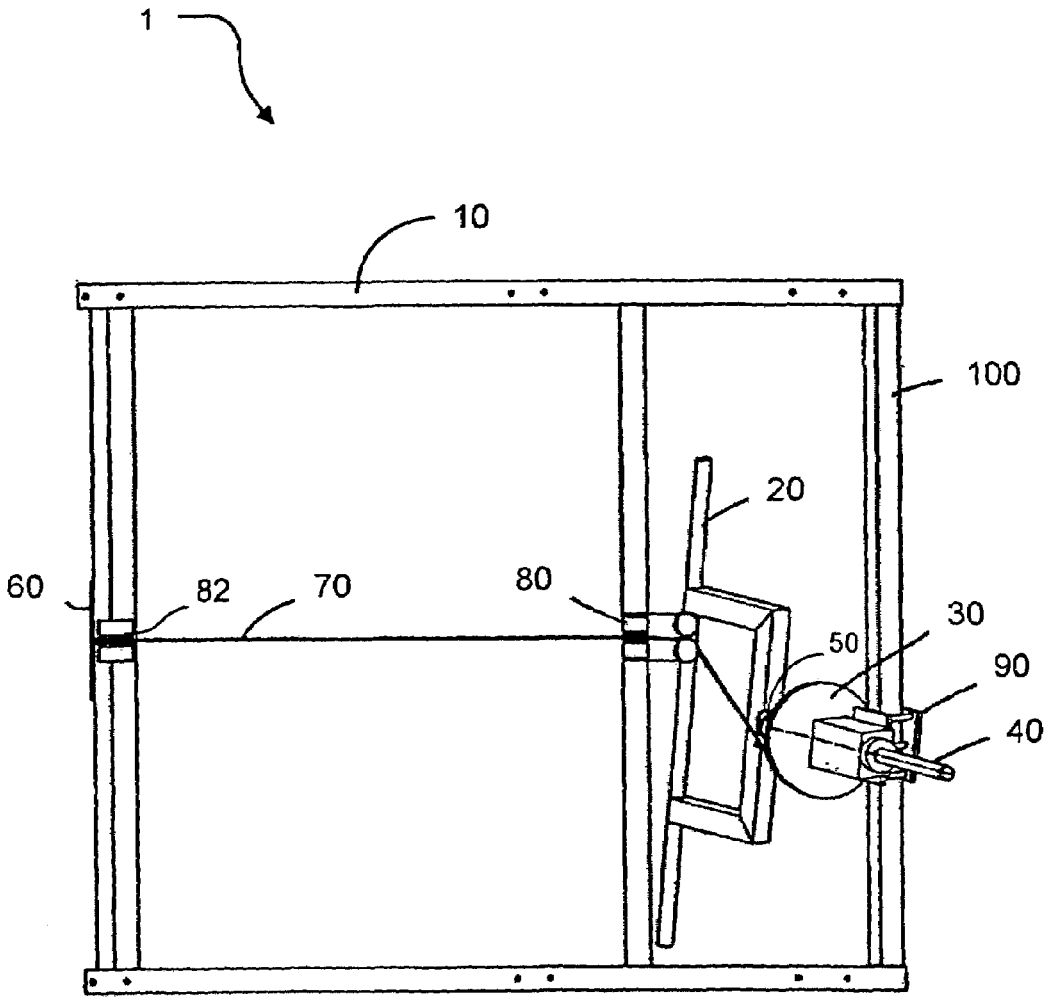
FIG. 4 depicts a top view of a golf exercise device, configured for a right-hand swing, in accordance with an embodiment of the present invention.

To properly simulate the preferred golf swing, golf exercise device 1 employs a flywheel 30 as a pivoting structure to guide the user's body through the correct position for a modern golf swing. As shown in FIG. 5, flywheel 30 is configured so as to allow rotation of the yoke 20 about the spinal axis of the user who will be performing the golf swing while using golf exercise device 1. That is, to achieve the preferred angular orientation for a proper golf swing, the user's spine should be at about 30-degree forward tilt from the waist (i.e., the angle "θ" is about 30 degrees as shown in FIG. 2) and about 10-degree lateral tilt (i.e., the angle "α" is about 10 degrees as shown in FIG. 3). The preferred golf swing is achieved by pivoting about that orientation, and, in doing so by use of golf exercise device 1, the user's body stays aligned in the proper position because the hips cannot advance ahead of the body since the user is restrained by the yoke 20. As such, the body can only turn golf exercise device 1 in sequence during the simulated swing, and all of the muscles used to perform the proper golf swing are utilized, and therefore, strengthened.

As shown in FIG. 1, flywheel 30 is connected to frame 10 through support arm 40, which is in turn slidably connected via a guide support 90 to the uppermost horizontal support bar 100 at the top of frame 10. The orientation of the support arm 40 is coincident with the center or axis of rotation of the flywheel 30. Flywheel 30 may be adjusted for height to accommodate different sized golfers by raising or lowering the support arm 40, but at all times flywheel 30 is supported by frame 10 in a manner to allow free rotation throughout the performance of the golf swing.

Flywheel 30 can easily be rotated in either a clockwise or a counterclockwise direction using the rotational joint 50 and can be switched from the right position for a right-handed golfer to the left position for a left-handed golfer. A configuration of golf exercise device 1 suitable for a left-handed golfer is depicted in FIG. 8. The mechanics and multiple degrees of freedom adjustment capabilities for the left-hand position work as described for the right-handed position. Also, golf exercise device 1 can be utilized to provide resistance to the backswing or through the swing. This is accomplished by switching the rotational direction of the flywheel 30 from clockwise to counterclockwise (and vice versa) by use of the rotational joint 50.

Other means for accomplishing the rotational motion about the user's spine can be employed, if desired, to include the use of an elliptical or non-circular flywheel to provide variable but controllable resistance at different positions of the swing. FIG. 9 illustrates one embodiment of the invention where the shape of flywheel 130 is substantially elliptical.

As shown in FIG. 1, resistance 60 is connected to flywheel 30 (discussed above) through a cable 70 that rides along a first pulley 80 and a second pulley 82 so that as flywheel 30 turns (in response to the user turning yoke 20 during performance of the golf swing), resistance 60 is raised or lowered in response to the performance of the golf swing. Adjusting the amount of resistance selected on resistance 60 allows the user to provide more or less resistance during the swing training.

Figure 10:
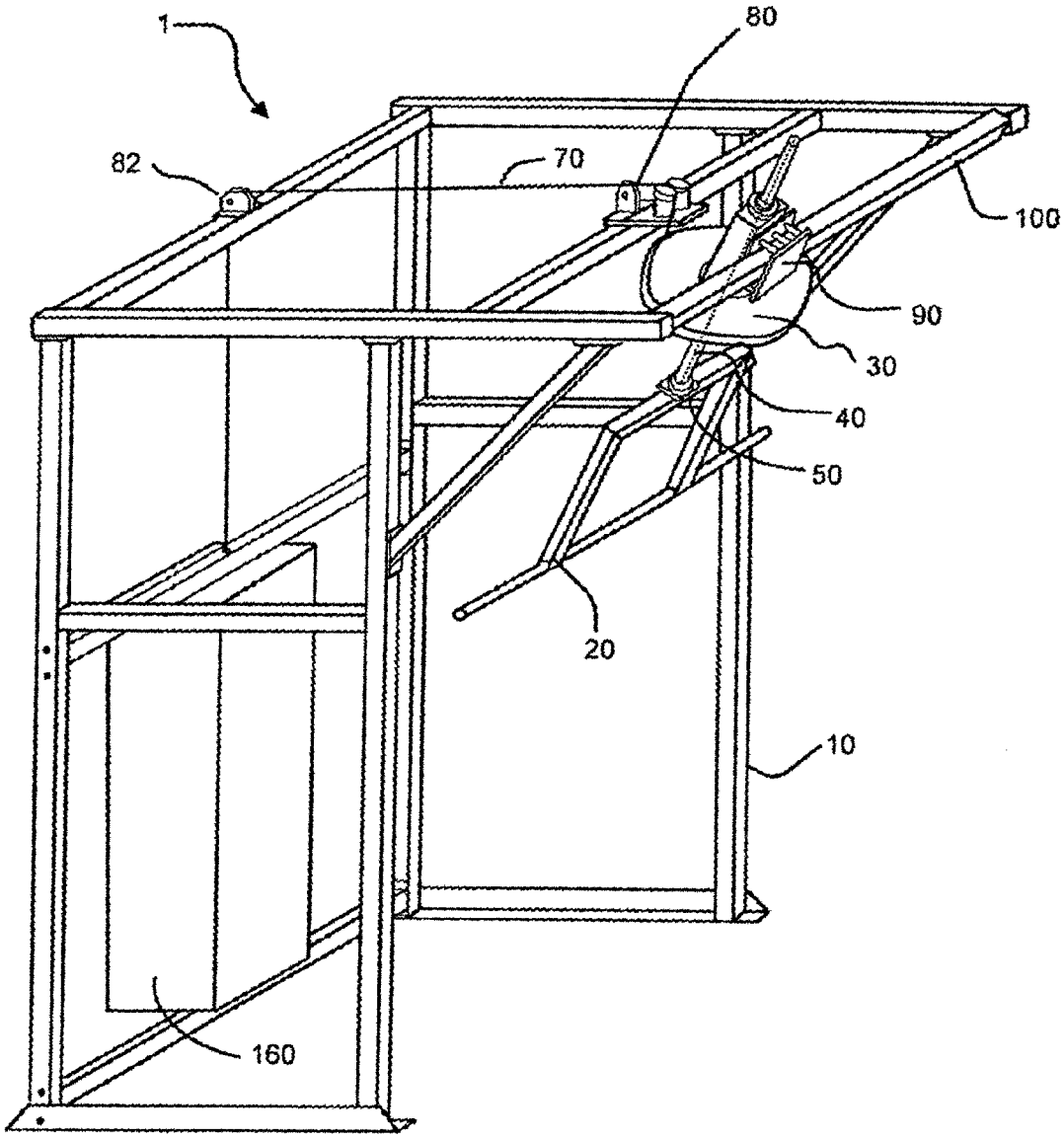
FIG. 10 depicts a left perspective view of a golf exercise device, configured for a right-hand swing, in accordance with an embodiment of the present invention.

Other means for providing resistance training to the user can be employed and are to be considered within the scope of the present disclosure for this invention. These include the use of hydraulic, electromechanical, elastic or other types of variable resistance. FIG. 10 illustrates one embodiment of the invention where resistance 160 may be one of a hydraulic mechanism, an electromechanical mechanism, and an elastic mechanism.

Yoke 20 is rotatably attached to flywheel 30 through joint 50 and support arm 40. Yoke 20 is sized so as to fit around the shoulders of the user, preferably being held in place during normal operation with the user's hands that are naturally held in a forward position to simulate the mechanics of a proper golf swing. As shown in FIG. 5, yoke 20 is in a hands-forward position. Other configurations and hand positions are possible and within the scope of the disclosed invention. Though the user's hands grasp the yoke 20, it is the large rotary muscles of the upper torso and thighs that are actually worked during performance of the golf swing since these muscles are what cause golf exercise device 1 to turn, as opposed to the muscles of the forearms that are worked during use of other conventional golf-swing training devices. Joint 50 is provided between the yoke 20 and the flywheel 30, to allow adjustment of the yoke 20 to accommodate a rotation of 360 degrees so that resistance can be applied to the golf swing in either a right-handed or left-handed configuration, as well as during the backswing or through swing.

In addition to the angular degrees of freedom, θ and α, as shown in FIGS. 2 and 3, respectively, and the height adjustment degree of freedom, an embodiment of this invention allows for adjustment of the angular position of the flywheel 30 about its own center of rotation that is coincident with the lengthwise axis of the support arm 40. This degree of freedom is designated as β in FIG. 2.

The golf exercise device may also be used by a user that is seated on a stool or some other resting device (not shown) for supporting the weight of the user's body while the upper torso and its associated muscles remain free to rotate during performance of the golf swing. This would allow isolation of the trunk and shoulder muscles because the upper thigh muscles would be inactive in that position.

The golf exercise device of the invention may also be coupled with a conventional video recording/monitoring system as a training aid and/or to provide the user real-time capability to visualize his/her swing. In addition, the golf exercise device may include analog, digital or wireless recording/monitoring equipment to keep track of weight used during training, as well as range of motion sensors for monitoring progress over time. These recording devices could also be used in conjunction with one or more conventional pressure or weight sensors under one or both feet to enable the user to monitor and visually detect his/her weight distribution on each leg during all phases of the golf swing. This provides another valuable training aid. Moreover, the yoke may be modified by addition of a golf club or the handle of a simulated golf club to provide the user with a more realistic feel during the training.

Many embodiments and adaptations of the present invention other than those herein described, will be apparent to those skilled in the art by the foregoing description thereof, without departing from the substance or scope of the invention. While the present invention has been described herein in detail in relation to its exemplary embodiments, it is to be understood that this disclosure is only illustrative and exemplary of the present invention. Accordingly, the foregoing disclosure is not intended to limit the scope of the present invention which is defined by the claims and their equivalents.

What is claimed is:

1. An exercise device comprising:

a frame;

a yoke assembly affixed to the frame, the yoke assembly including:

a yoke configured for engagement by a user in an exercise orientation;

a support arm affixed to the yoke at a rotational joint, the support arm having a support arm rotational axis, the support arm being selectively adjustable relative to the frame to provide the support arm rotational axis with a selected forward inclination and a selected posterior/lateral inclination, the support arm being further adjustable to an exercise height for the user;

a guide support to which the support arm is selectively, slidably affixed;

a flywheel affixed on the support arm; and a resistance apparatus affixed to the flywheel, the resistance apparatus including a resistance, wherein a force applied to the yoke causes rotational movement of the yoke around the support arm rotational axis and further causes rotational movement of the flywheel which in turn causes the movement of the resistance relative to the force applied.

2. The exercise device of claim 1, wherein the forward inclination is about 30 degrees.

3. The exercise device of claim 1, wherein the posterior inclination is about 10 degrees.

4. The exercise device of claim 1, wherein the frame further includes a horizontal support bar.

5. The exercise device of claim 4, wherein the guide support is slidably affixed to the horizontal support bar.

6. The exercise device of claim 1, wherein the resistance apparatus includes a cable having a first end portion and a second end portion, the first end portion affixed to the flywheel, the second end portion affixed to the resistance, the cable disposed on a pulley assembly for movement in the exercise device.

7. The exercise device of claim 1, wherein the resistance comprises a weight stack.

8. The exercise device of claim 7, wherein the flywheel is substantially elliptical.

9. The exercise device of claim 1, wherein the resistance comprises a hydraulic cylinder.

10. The exercise device of claim 1, wherein the resistance comprises an elastic band assembly.

11. The exercise device of claim 1, wherein the resistance comprises an electro-mechanical device.

12. The exercise device of claim 1, wherein the flywheel is circular.

13. The exercise device of claim 1, wherein the flywheel is non-circular.

14. The exercise device of claim 1, wherein the frame further includes a plurality of wheels.

15. The exercise devices of claim 1, wherein the frame is configured to be securable to a vertical surface.

16. The exercise device of claim 1, wherein the frame is configured to depend from a horizontal surface.

* * * * *